US007753473B2

(12) United States Patent
Nakashima

(10) Patent No.: US 7,753,473 B2
(45) Date of Patent: Jul. 13, 2010

(54) LIQUID EJECTING APPARATUS

(75) Inventor: Atsuhisa Nakashima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 762 days.

(21) Appl. No.: 11/562,758

(22) Filed: Nov. 22, 2006

(65) Prior Publication Data

US 2007/0139465 A1 Jun. 21, 2007

(30) Foreign Application Priority Data

Nov. 24, 2005 (JP) ..... 2005-338332

(51) Int. Cl.
*B41J 2/165* (2006.01)

(52) U.S. Cl. ..... 347/29; 347/30; 347/31; 347/32

(58) Field of Classification Search ..... 347/29, 347/30, 32, 33, 31
See application file for complete search history.

(56) References Cited

U.S. PATENT DOCUMENTS

| | | | |
|---|---|---|---|
| 6,793,317 | B2 | 9/2004 | Shima |
| 7,399,055 | B2 | 7/2008 | Okamoto |
| 2002/0060713 | A1 | 5/2002 | Katakura et al. |
| 2005/0062794 | A1 | 3/2005 | Kanamitsu et al. |
| 2005/0168517 | A1 | 8/2005 | Usuda |

FOREIGN PATENT DOCUMENTS

| | | | |
|---|---|---|---|
| EP | 1060893 | A1 | 12/2000 |
| EP | 1162069 | A2 | 12/2001 |
| JP | 04-112045 | A | 4/1992 |
| JP | 2004-112045 | A | 4/1992 |
| JP | 2001-080086 | A | 3/2001 |
| JP | 2003080086 | A | 3/2001 |
| JP | 2002326366 | A | 11/2002 |
| JP | 2003220705 | A | 8/2003 |
| JP | 2004-299105 | A | 10/2004 |

OTHER PUBLICATIONS

European Patent Office, European Search Report dated Oct. 2, 2007 for Related Application No. EP 06024242.

Japan Patent Office; Notice of Reasons for Rejection in Japanese Patent Application No. 2005-338332 (counterpart to the above-captioned U.S. patent application) mailed Sep. 15, 2009, USPTO received on Dec. 3, 2009.

*Primary Examiner*—Shih-Wen Hsieh
(74) *Attorney, Agent, or Firm*—Baker Botts, LLP

(57) ABSTRACT

A liquid ejecting apparatus has a movement mechanism, a pressurized purge unit, and a liquid discharge restriction mechanism. The movement mechanism moves at least one of a liquid ejecting head and a cap so as to allow the cap to take a capping position where the cap covers a liquid ejection face of the head or an uncapping position where the cap is spaced away from the liquid ejection face and capable of receiving liquid ejected from nozzles formed on the liquid ejection face. The pressurized purge unit makes liquid forcibly ejected from the nozzles into the cap. The liquid discharge restriction mechanism restricts liquid from being discharged through a discharge port of the cap when the cap is in the capping position, and permits liquid to be discharged through the discharge port when the cap is in the uncapping position.

10 Claims, 5 Drawing Sheets

LIQUID EJECTING APPARATUS

BACKGROUND OF THE INVENTION

1. Field of the Invention

The present invention relates to a liquid ejecting apparatus that performs printing by ejecting liquid to a record medium.

2. Description of Related Art

Japanese Patent Unexamined Publication No. 2003-220705 discloses, in FIG. 1, an ink-jet printer that, along with movement of a carriage, ejects ink from a printer head to a paper. In the ink-jet printer, the printer head includes four piezoelectric head units that eject ink from nozzles. The ink-jet printer is provided with a purge cap and four caps disposed adjacent to the purge cap. When the printer head is in a reset position, the purge cap forcibly sucks and removes air, dust, or the like, which is accumulated inside the head units, together with ink. The four caps cover the nozzles of the respective head units, to thereby prevent ink contained within the nozzle from drying.

SUMMARY OF THE INVENTION

In the above-described ink-jet printer, one purge cap serves to purge the four head units individually. Therefore, when all the four head units are purged, it takes much time to perform a purge operation. By providing the printer with four purge caps corresponding to the head units, respectively, or with a tray-type ink receiver corresponding to the four head units, the four heads can be purged in a short time, because all the head units can be purged simultaneously. However, if such purge caps or such an ink receiver are/is provided in addition to the four caps that cover the nozzles of the respective head units to thereby prevent ink contained within the nozzle from drying, a size of the printer is increased.

An object of the present invention is to provide a liquid ejecting apparatus capable of downsizing.

According to an aspect of the present invention, there is provided a liquid ejecting apparatus comprising a liquid ejecting head, a cap, a movement mechanism, a pressurized purge unit, and a liquid discharge restriction mechanism. The liquid ejecting head has a liquid ejection face on which a plurality of nozzles are formed. The cap covers the liquid ejection face, and has an opening through which liquid ejected from the nozzles is received and a discharge port through which liquid is discharged to outside. The movement mechanism moves at least one of the liquid ejecting head and the cap so as to allow the cap to take a capping position where the cap covers the liquid ejecting face or an uncapping position where the cap is spaced away from the liquid ejection face and capable of receiving liquid ejected from the nozzles. The pressurized purge unit makes liquid forcibly ejected from the nozzles into the cap. The liquid discharge restriction mechanism restricts liquid from being discharged through the discharge port when the cap is in the capping position, and permits liquid to be discharged through the discharge port when the cap is in the uncapping position.

In this aspect, when the cap is in the uncapping position, the cap receives liquid ejected from the nozzles by the pressurized purge unit and the liquid thus received can be discharged from inside of the cap to outside through the discharge port. That is, the cap, which covers the liquid ejection face and thus prevents liquid contained within the nozzles from drying up, can also serve to receive and discharge liquid that has been ejected by the pressurized purge unit. As a result, downsizing of the apparatus can be realized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
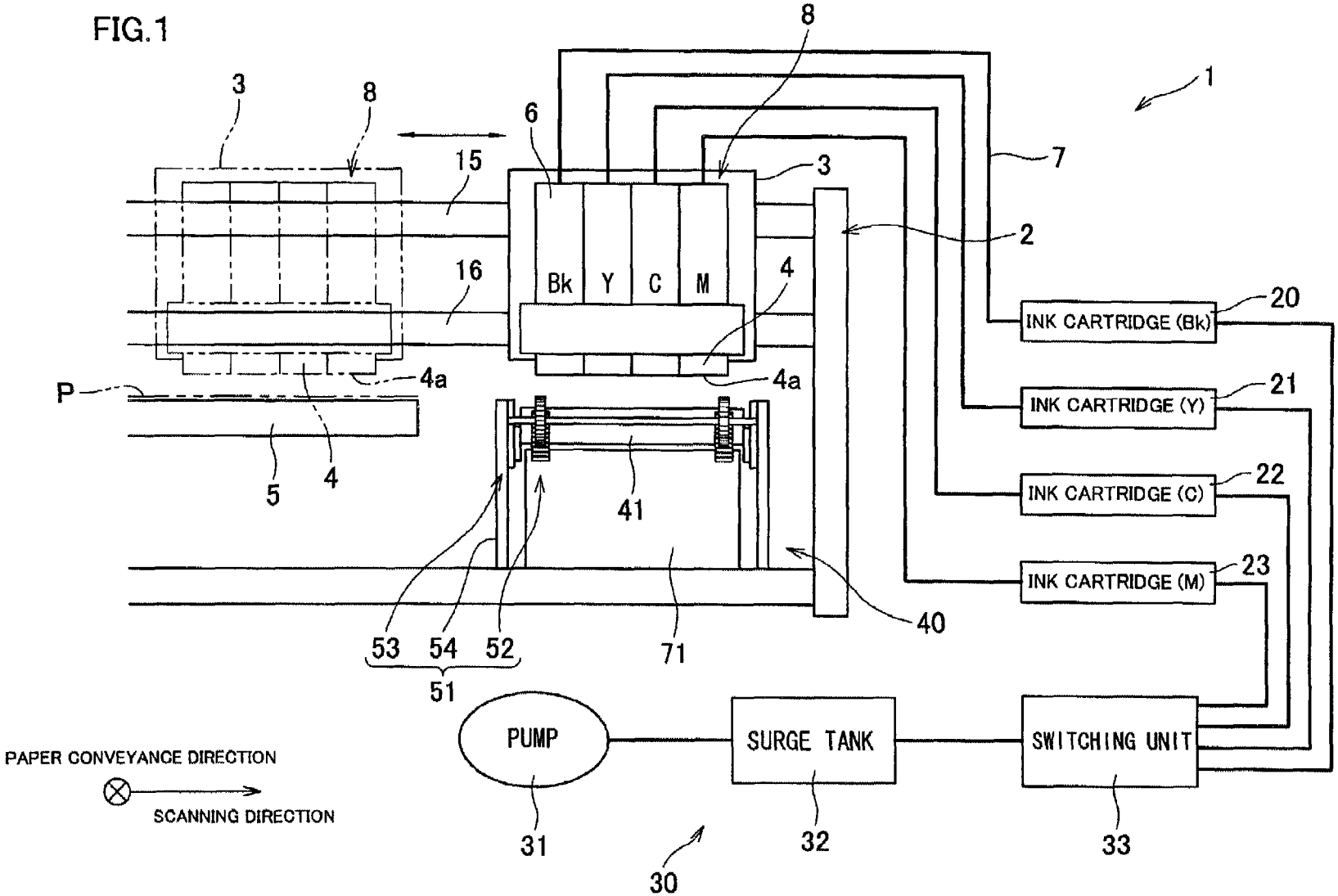
FIG. 1 schematically illustrates a color ink-jet printer according to an embodiment of the present invention.

First, with reference to FIG. 1, a description will be given to a general construction of a color ink-jet printer according to an embodiment of the liquid ejecting apparatus of the present invention. As shown in FIG. 1, a color ink-jet printer 1 of this embodiment includes a carriage 3 and a head unit 8. The carriage 3 is provided on a main body frame 2 in such a manner that it can reciprocate in a right-and-left direction in the figure. The head unit 8 is mounted on the carriage 3. A platen 5 is provided inside the main body frame 2. The platen 5 serves to support a paper P that is conveyed by a feed roller (not shown) and the like and comes forward, that is, comes to this side with respect to FIG. 1.

The carriage 3 moves in the right-and-left direction in FIG. 1, along two guide shafts 15 and 16 that are fixed to the main body frame 2. The head unit 8 has four ink-jet heads 4 that eject black ink, yellow ink, cyan ink, and magenta ink, respectively. Nozzles (not shown) for ejecting ink are formed on bottom faces of the ink-jet heads 4 which mean ink ejection faces 4*a*. The head unit 8 has four sub tanks 6 each of which is disposed above a corresponding ink-jet head 4 and connected to the corresponding ink-jet head 4. Each of the four sub tanks 6 is connected, via a tube 7, to corresponding one of ink cartridges 20 to 23, so that ink contained in the ink cartridges 20 to 23 is supplied to the ink-jet heads 4 through the sub tank 6. As illustrated with an alternate long and two short dashes line in FIG. 1, the four ink-jet heads 4 take such a position that the ink ejection faces 4*a* confronts the platen 5, and in this position the four ink-jet heads 4 together with the carriage 3 reciprocate in a scanning direction (i.e., in the right-and-left direction in FIG. 1) while ejecting ink of the respective colors from the nozzles to the paper P which is being conveyed forward. Thus, a desired image is formed on the paper P.

The ink-jet printer 1 has a purge mechanism 30. The purge mechanism 30 performs a purge operation, in a case where an ejection failure occurs because a foreign substance such as air and dust is mixed into ink passages, which includes nozzles and are formed within the ink-jet head, or because thickened ink, which means ink having increased viscosity due to drying, clogs the nozzles. In the purge operation, ink is forcibly ejected through the nozzles so that foreign substance existing inside the ink passages or thickened ink clogging the nozzles is discharged to outside.

As shown in FIG. 1, the purge mechanism 30 includes an air pump 31, a surge tank 32, and a switching unit 33. Air pressurized by the air pump 31 is once stored in the surge tank 32. The switching unit 33 supplies air stored in the surge tank 32 simultaneously or selectively to the four ink cartridges 20 to 23. The purge mechanism 30 supplies air pressurized by the air pump 31 to all or selected one(s) of the ink cartridges 20 to 23 via the surge tank 32 and the switching unit 33. Within the ink cartridges 20 to 23 thus supplied with pressurized air, pressure is applied to ink so that ink is forcibly ejected from nozzles of the corresponding ink-jet head 4. This purge operation will be referred to as a positive pressure purge.

The positive pressure purge provides higher purge pressure, that is, higher ink-discharge pressure, as compared with a suction purge in which a pump connected to a cap that covers an ink ejection face of an ink-jet head generates suction force for making ink ejected from nozzles into the cap. Accordingly, the foreign substance such as air and dust entrapped in the ink passage or the thickened ink clogging the nozzles can be discharged more effectively, while the amount of ink ejected in the purge operation, that is, consumption of ink, can be lowered.

A single-color purge which means ejecting ink from a particular head can be performed, by selectively switching, among the ink cartridges 20 to 23, an ink cartridge to which pressurized air is supplied, by means of the switching unit 33. Performing the single-color purge can further reduce the consumption of ink that is used for a purge operation, because ink ejection from the heads presenting no ejection failure and therefore requiring no purge operation, which is unnecessary, can be avoided. In addition, by setting the switching unit 33 so as to simultaneously supply pressurized air to all the four ink cartridges 20 to 23, the four ink-jet heads 4 can be subjected to the purge operation at one time. In this case, a time required for a purge operation can be shortened as compared with when a purge operation is performed on the ink-jet heads 4 separately.

As shown in FIG. 1, when the ink-jet heads 4 do not perform printing on the paper P, the head unit 8 is withdrawn into a maintenance position (at a right side in FIG. 1) that does not confront the platen 5 which is a conveyance path for the paper P. While the head unit 8 is in the maintenance position, the ink-jet heads 4 confront the maintenance mechanism 40. The maintenance mechanism 40 covers the ink ejection faces 4*a* of the ink-jet heads 4 thus preventing ink contained within the nozzles from drying, or receives ink that has been ejected from the nozzles during the purge operation.

Figure 2A:
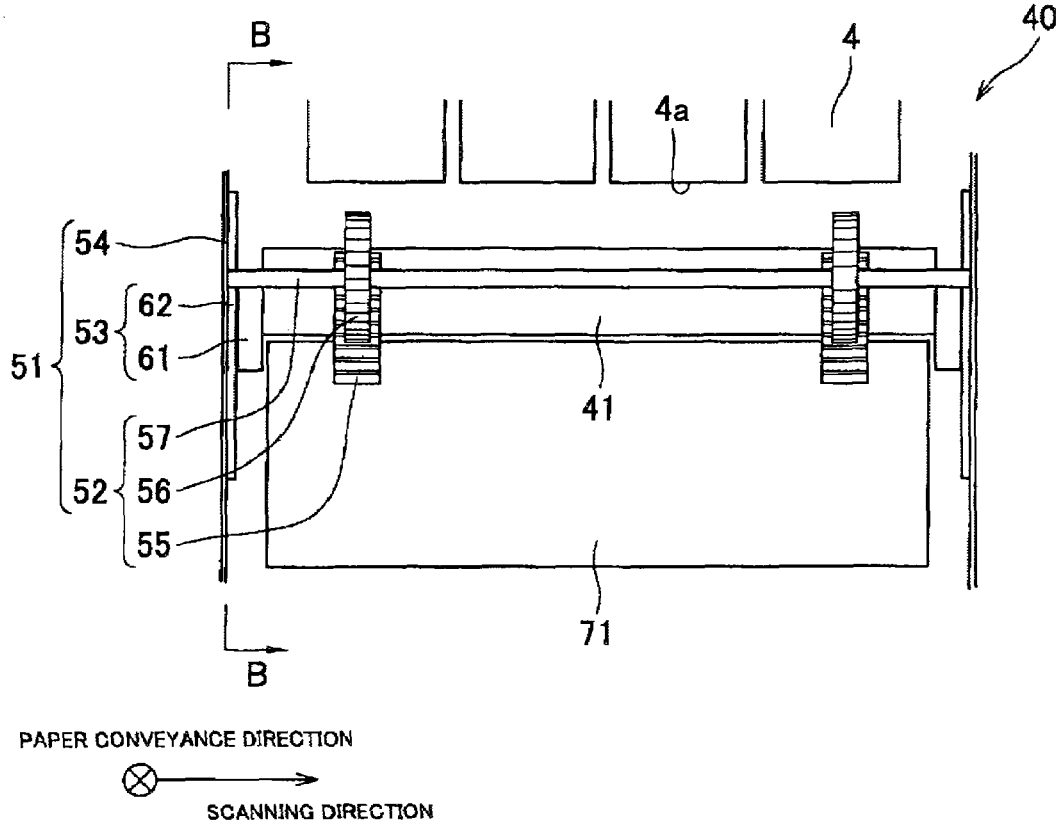
FIG. 2A is a front view of a maintenance mechanism shown in FIG. 1.
Figure 2B:
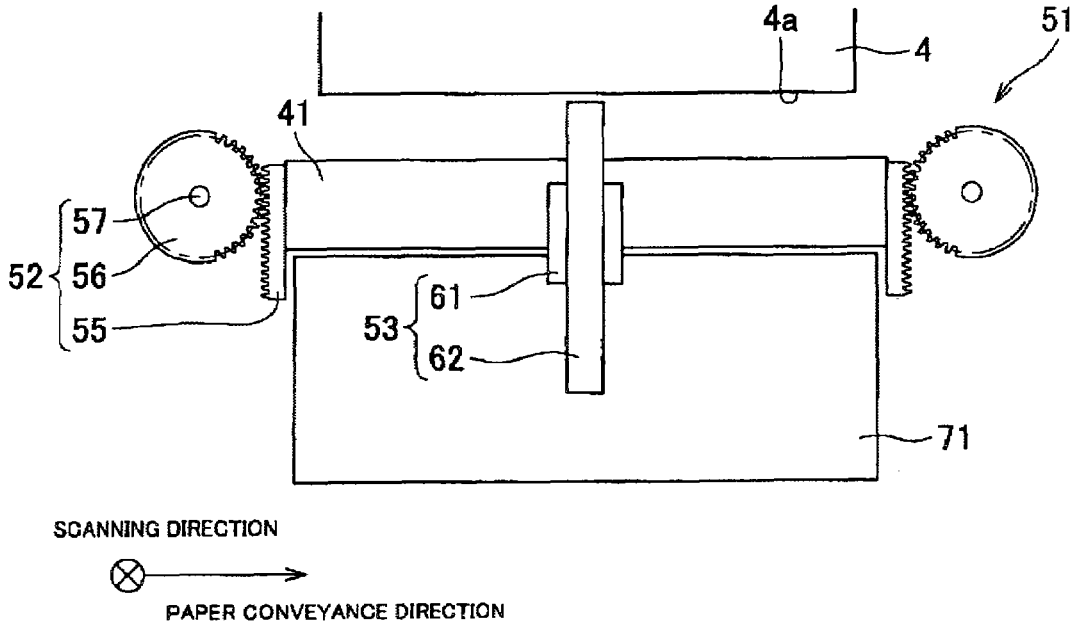
FIG. 2B is a sectional view taken along a line B-B of FIG. 2A.
Figure 3:
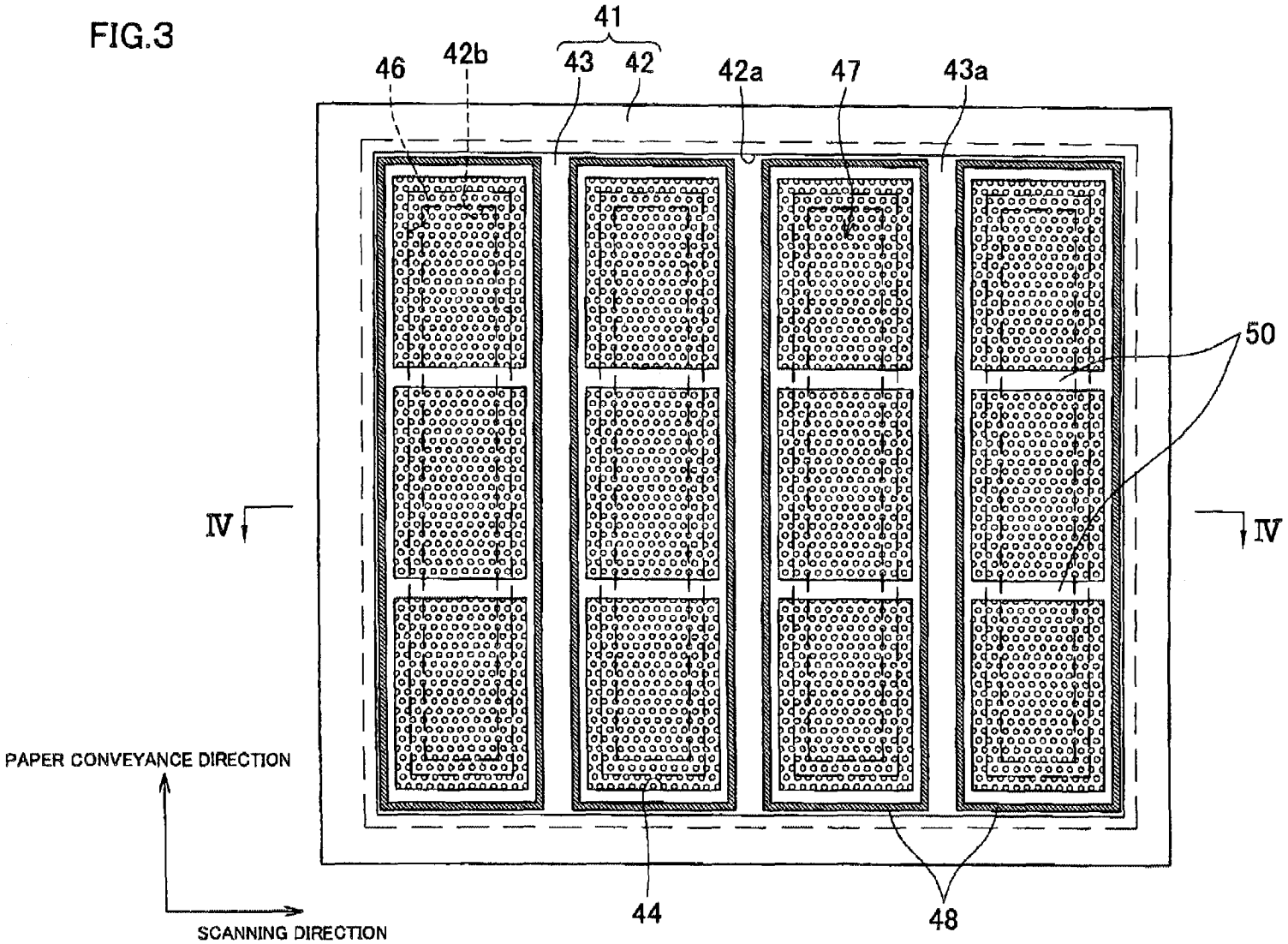
FIG. 3 is a plan view of the maintenance mechanism.
Figure 4:
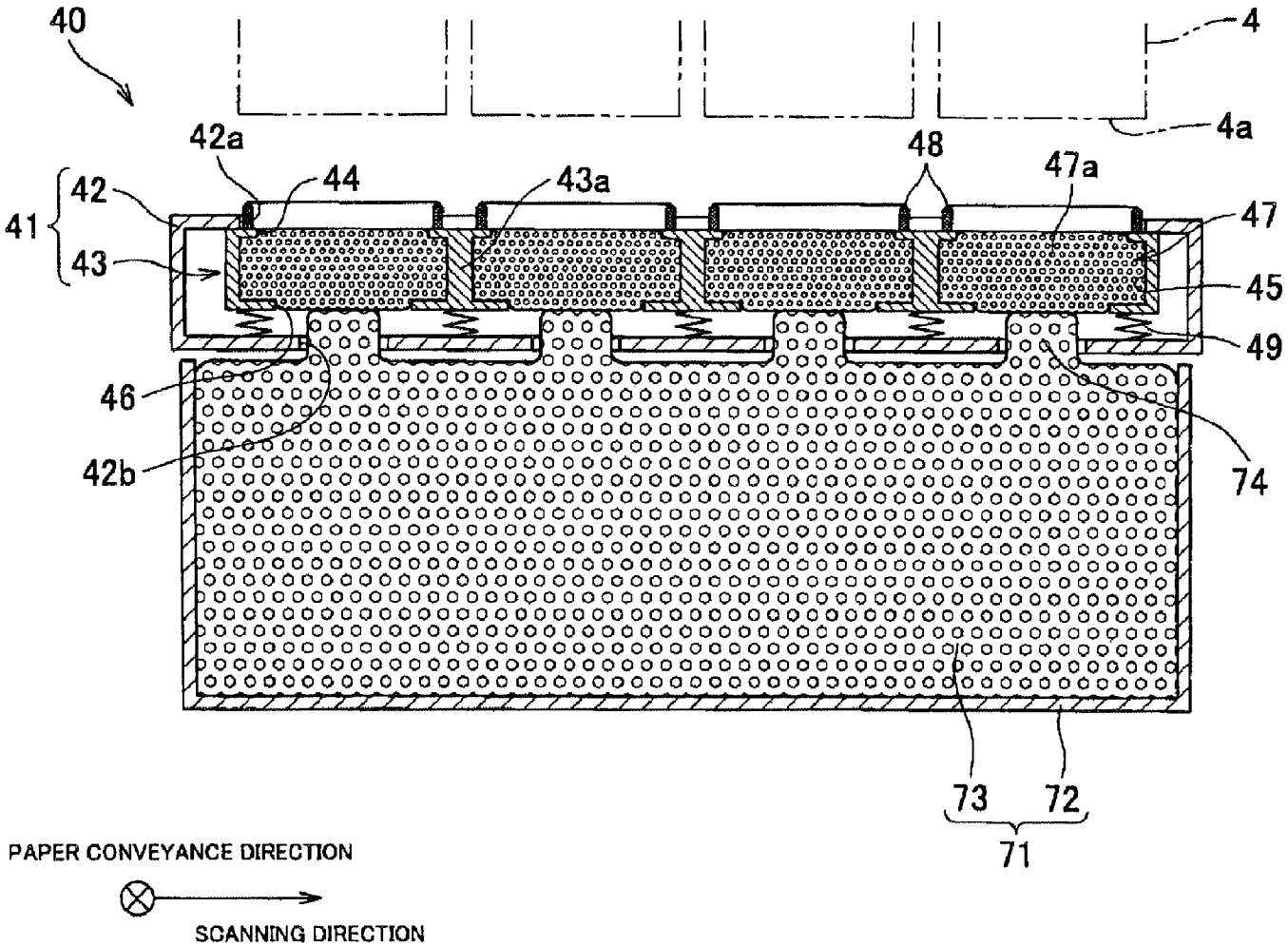
FIG. 4 is a sectional view taken along a line IV-IV of FIG. 3.

FIG. 2A is a front view of the maintenance mechanism 40 shown in FIG. 1. FIG. 2B is a sectional view taken along a line B-B of FIG. 2A. FIG. 3 is a plan view of the maintenance mechanism 40. FIG. 4 is a sectional view taken along a line IV-IV of FIG. 3. As shown in FIGS. 1, 2A, and 2B, the maintenance mechanism 40 includes a cap unit 41, a movement mechanism 51, and a waste ink reservoir 71. The movement mechanism 51 moves the cap unit 41 toward and away from the ink ejection faces 4*a* (i.e., in an up-and-down direction in FIGS. 2A and 2B). The waste ink reservoir 71 is disposed under the cap unit 41 so as to receive and hold ink that is discharged from communication holes 46 of a cap 43.

As shown in FIGS. 2A and 2B, the movement mechanism 51 includes a drive mechanism 52, a guide mechanism 53, and a support member 54. The guide mechanism 53 guides movement of the cap unit 41. The support member 54 extends upward from the main body frame 2, and supports the drive mechanism 52 and the guide mechanism 53. The drive mechanism 52 includes four racks 55, four pinion gears 56, and two rotation shafts 57. Two of the four racks 55 are fixed to one side face of the cap unit 41, and the other two are fixed to the other side face of the cap unit 41. The four pinion gears 56 are engaged with the respective racks 55. The two rotation shafts 57 are rotatably supported on the support member 54. Two pinion gears 56 are fixed to each of the rotation shafts 57. The guide mechanism 53 includes two sliders 61 and two guide plates 62. The two sliders 61 are fixed respectively to both side faces of the cap unit 41 different from its side faces to which the racks 55 are fixed. The two guide plates 62 are fixed to the support member 54. On surfaces of the guide plates 62, the sliders 61 slide in the up-and-down direction. When a drive source (not shown) is driven to rotate the rotation shafts 57, the pinion gears 56 rotate together with the rotation shafts 57. Along with this rotation of the pinion gears 56, the racks 55 together with the cap unit 41 move up and down.

As shown in FIGS. 3 and 4, the cap unit 41 has a casing 42 and a cap 43 disposed within the casing 42. The casing 42 has a substantially square opening 42*a* at its upper face, and four rectangular openings 42*b* at its lower face. The opening 42*a* corresponds to the four ink-jet heads 4 as located in the maintenance position. The four openings 42*b* correspond respectively to the four ink-jet heads 4 as located in the maintenance position.

The cap 43 has a substantially rectangular parallelepiped shape. In the cap 43, four cavities 45 are formed at positions corresponding to the respective ink-jet heads 4. Four rectangular openings 44 are formed on the upper face of the cap 43, and four communication holes 46 are formed on the lower face of the cap 43. Each of the cavities 45 communicates with the exterior via the opening 44 and the communication hole 46. In a plan view, each of the four openings 44 is slightly larger than a region of the ink ejection face 4*a* where nozzles are formed. The four cavities 45 are partitioned by partition walls 43*a*. In these independent cavities 45, ink holders 47 having a large number of pores 47*a* are disposed.

Something capable of absorbing and holding a predetermined amount of ink may serve as the ink holder 47. In this embodiment, a sponge having elasticity is applied as the ink holder 47. The ink holder 47 is disposed so as to close the opening 44 and the communication hole 46, in a state of being compressed in order to produce substantially no gap between the ink holder 47 and an inner wall of the cavity 45 including the partition wall 43*a*.

As shown in FIG. 3, each of the openings 44 is divided into three by means of two stoppers 50. The two stoppers 50 are arranged side by side along a longitudinal direction of the opening 44, and extend along the scanning direction of the head 4. Since the stoppers 50 are thus provided on the cap 43, the ink holder 47 disposed inside the cavity 45 is partially pushed and therefore can be prevented from protruding outward from the opening 44, that is, protruding toward the ink-jet head 4. This can prevent the ink holder 47 from coming into contact with the ink ejection face 4*a* when the cap 43 covers the ink ejection face 4*a*. Consequently, damage to the ink ejection face 4*a* due to a contact with the ink holder 47 can be avoided, and ink held in the ink holder 47 can be prevented from adhering to the ink ejection face 4*a*.

The cap 43 has, on its upper face, four annular lips 48 that surround and thereby define the respective openings 44. The lips 48 are made of an elastic material such as rubber. A height of the lip 48 is such that, when the cap 43 is biased upward by a later-described spring 49, an end of the lip 48 can protrude from the upper face of the casing 42. Since the lips 48 is provided like this, when the cap unit 41 is moved upward, the lips 48 made of an elastic material come into contact with the ink ejection faces 4*a* and therefore the ink ejection faces 4*a* are not easily damaged.

Within the casing 42, five springs 49 are provided. The partition walls 43*a* of the cap 43 and both ends of the cap 43 with respect to the scanning direction are biased upward by the springs 49. The springs 49 thus biasing the cap 43 serve to buffer an impact which occurs when the cap unit 41 is moved up and the lips 48 get pressed against outer peripheries of the ink ejection faces 4*a*. Accordingly, the ink ejection faces 4*a* are not easily damaged by the lips 48. At this time, moreover, a difference in parallelism between the ink ejection faces 4*a* and the upper face of the cap 43, which cannot be fully corrected even through elastic deformation of the lips 48, can be corrected by the spring 49. That is, even when the upper face of the cap 43 is somewhat oblique with respect to the ink ejection faces 4*a*, the springs 49 serves to correct a difference in parallelism by balancingly getting compressed in a biasing direction so as to bring the upper face of the cap 43 and the ink ejection faces 4*a* toward a parallel condition. As a result, substantially no gap is formed between the lips 48 and the ink ejection faces 4*a*, and the contact between the lips 48 and the ink ejection faces 4*a* improves. Therefore, a space enclosed with the ink ejection face 4*a*, the lip 48, and the ink holder 47 can substantially perfectly be sealed up.

As shown in FIG. 4, the waste ink reservoir 71 includes a housing 72 and an ink absorber 73. The housing 72 opens toward the cap unit 41. The ink absorber 73 is disposed within the housing 72. In a plan view, a shape of the housing 72 and a shape of the cap unit 41 have substantially the same size. The ink absorber 73 has four protrusions 74 that protrude from an upper face of the ink absorber 73 upwardly, i.e., toward the communication holes 46. The four protrusions 74 are capable of passing through the respective openings 42*b* of the casing 42. In this embodiment, the ink absorber 73 is, like the ink holder 47, made of a sponge. Accordingly, when the protrusions 74 are in contact with portions of the ink holders 47 exposed through the communication holes 46 as shown in FIG. 4, ink held in the ink holder 47 is forcibly sucked out by the ink absorber 73. The ink sucked out of the ink holder 47 naturally moves down from the protrusions 74. The ink absorber 73 is capable of sucking ink out of the ink holder 47 until ink accumulated on a bottom of the housing 72 comes up to upper ends of the protrusions 74.

Figure 5A:
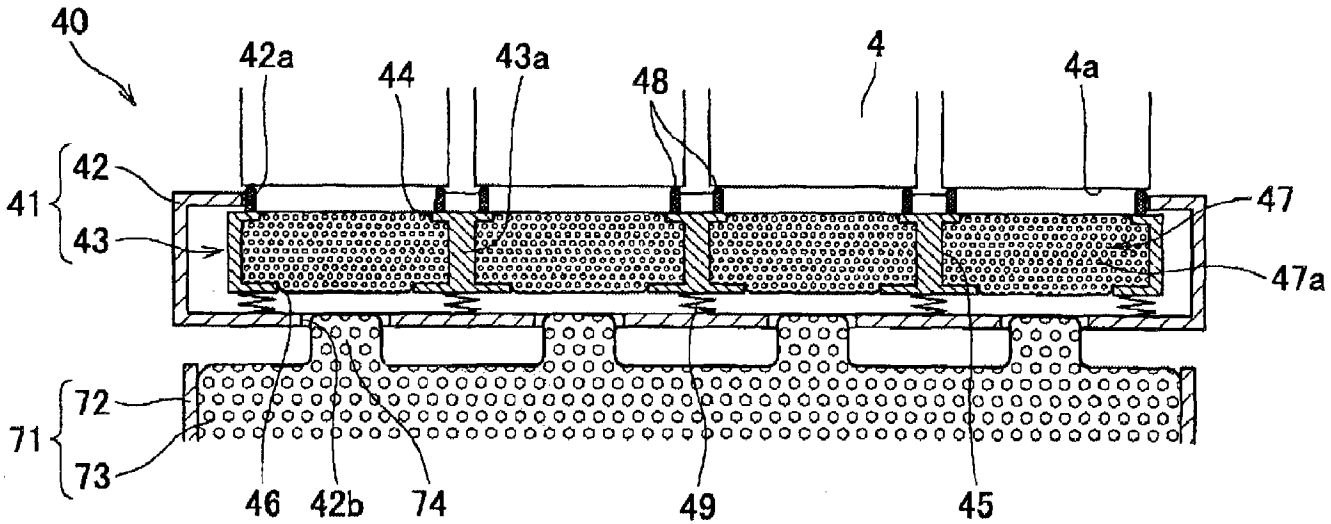
FIGS. 5A and 5B illustrate operational states of the maintenance mechanism.
Figure 5B:
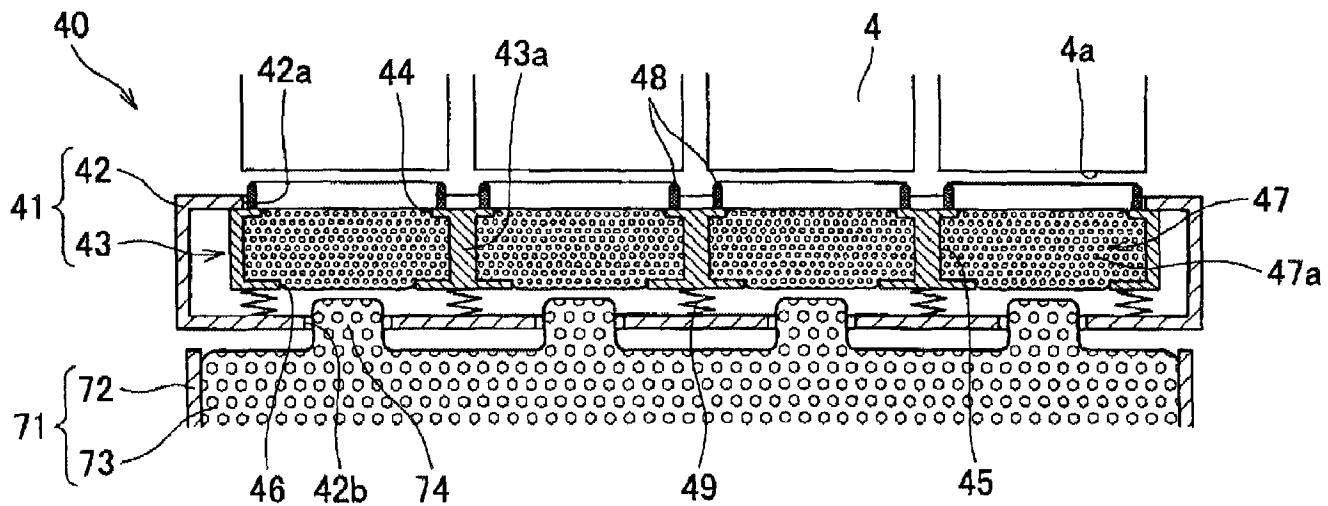

Next, an operation of the maintenance mechanism 40 will be described below. FIGS. 5A and 5B illustrate operational states of the maintenance mechanism 40

The cap unit 41 is placed in a position shown in FIG. 4, while the ink-jet heads 4 are performing printing by ejecting ink to the paper P and while the ink-jet heads 4 are being purged by the purge mechanism 30. At this time, even though the head unit 8 is placed in the maintenance position, the lips 48 are spaced away from the ink ejection faces 4*a* and therefore the ink-jet heads 4 and the cap unit 41 are not in contact with each other. Such a position of the cap unit 41 will be referred to as an uncapping position.

In FIG. 4, the protrusions 74 of the ink absorber 73 and the portions of the ink holders 47 exposed through the communication holes 46 are in contact with each other. Therefore, ink held in the ink holders 47 is sucked out through the protrusions 74 into the ink absorber 73. The ink moves down, and stored in the waste ink reservoir 71. If, in a purge operation, a large amount of ink is ejected at one time, the ink holders 47 cannot hold a whole of the ink so that the ink may undesirably overflow the cap 43 and pollute inside of the printer 1. This problem can be suppressed when the ink holders 47 and the ink absorber 73 are in contact with each other, because ink held in the ink holders 47 is quickly sucked out into the ink absorber 73.

In order to, in a state where the head unit 8 is in the maintenance position, cover the ink ejection faces 4*a* with the cap 43, the movement mechanism 51 moves the cap unit 41 upward from the position shown in FIG. 4, and place the cap unit 41 in a capping position (see FIG. 5A). When the cap unit 41 is in the capping position, the lips 48 and the outer peripheries of the ink ejection faces 4*a* are in contact with each other. At this time, since the cap 43 is biased by the springs 49, an impact caused by contact between the lips 48 and the ink ejection faces 4*a* is buffered, and in addition the lips 48 and the ink ejection faces 4*a* are surely in close contact with each other. Moreover, the ink holders 47 hold a predetermined amount of ink by holding, in the pores 47*a*, ink ejected from the nozzles in a purge operation. Therefore, the communication holes 46 are substantially completely closed with the ink holders 47. As a result, the spaces enclosed with the ink ejection faces 4*a*, the lips 48, and the ink holders 47 are substantially completely sealed up, thus effectively preventing ink contained in the nozzles from drying up. Further, since the ink holders 47 are wet with ink, insides of the aforesaid spaces are kept humid. This can more effectively prevent ink contained in the nozzles from drying up.

When the cap unit 41 is in the capping position shown in FIG. 5A, the ink holders 47 are spaced away from the ink absorber 73. Therefore, as long as an amount of ink held has not yet reached capacity, the ink holders 47 hold ink without discharging it. That is, when the cap unit 41 is in the capping position, discharging of ink through the communication holes 46 is restrained. Once the amount of ink held in the ink holders 47 reaches the capacity, an amount of ink exceeding the capacity is discharged naturally through the communication holes 46. The ink discharged through the communication holes 46 is, via the protrusions 74 which are disposed in the openings 42*b* thereunder, absorbed into the ink absorber 73.

When a small amount of ink is ejected from the nozzles in a purge operation, an amount of ink held in the ink holder 47 is also small. In this case, as shown in FIG. 5B, the movement mechanism 51 places the cap unit 41 into the uncapping position. While the cap unit 41 is in the uncapping position in FIG. 5B, the lips 48 are spaced away from the ink ejection faces 4*a* and at the same time the protrusions 74 are spaced away from the portions of the ink holders 47 exposed through the communication holes 46. This is for the purpose of avoiding an exhaustion of the ink held in the ink holders 47, which may occur if the protrusions 74 and the ink holders 47 holding a small amount of ink are in contact with each other and thus the protrusions 74 steadily keep sucking ink out of the ink holders 47.

The cap unit 41 positioned in the uncapping position is, by the movement mechanism 51, appropriately placed into a position where the ink holders 47 and the ink absorber 73 are in contact with each other (see FIG. 4), or into a position where the ink holders 47 and the ink absorber 73 are spaced away from each other (see FIG. 5B). Thereby, the ink holders 47 can keep holding a proper amount of ink. Since the ink holders 47 keep holding a proper amount of ink, as described above, ink contained in the nozzles can be effectively prevented from drying up by the cap unit 41 being in the capping position.

As thus far described above, in this embodiment, when the cap unit 41 is in the uncapping position shown in FIG. 4 or FIG. 5B, ink ejected from the nozzles into the cap 43 by means of the purge mechanism 30 is held in the ink holders 47 and then may be discharged through the communication holes 46. To be more specific, in a case where the cap unit 41 is in the uncapping position shown in FIG. 4, the ink holders 47 and the protrusions 74 are in contact with each other, so that ink held in the ink holders 47 is absorbed into the absorber 73 through the communication holes 46. On the other hand, where the cap unit 41 is in the uncapping position shown in FIG. 5B, at the time when an amount of ink held in the ink holders 47 reaches capacity, an amount of ink exceeding the capacity is discharged naturally through the communication holes 46. Similarly, in a case where the cap unit 41 is in the capping position shown in FIG. 5A, discharging of ink through the communication holes 46 is restrained. That is, as long as an amount of ink held has not yet reached capacity, the ink holders 47 hold ink without discharging it, while once the amount of ink held in the ink holders 47 reaches the capacity, an amount of ink exceeding the capacity is discharged naturally through the communication holes 46. As a result, when the cap unit 41 is in the capping position, the communication holes 46 are closed with the ink holders 47 that hold a predetermined amount of ink. Therefore, the spaces enclosed with the ink ejection faces 4*a*, the lips 48, and the ink holders 47 are substantially completely sealed up, thus preventing insides of the nozzles from drying up.

Thus, the cap 43 including the ink holders 47 has two functions of covering the ink ejection faces 4*a* to prevent the nozzles from drying up and of discharging into the waste ink reservoir 71 ink ejected from the nozzles in a purge operation. Accordingly, it is not necessary to provide, in addition to a cap for prevention of drying, any member used for a purge operation. This allows the printer 1 to be downsized.

The ink holders 47 are provided within the cap 43 while closing the communication holes 46. Thus, the communication holes 46 are closed with the ink holders 47 that hold ink. Therefore, when the cap unit 41 is in the capping position, the spaces enclosed with the ink ejection faces 4*a*, the lips 48, and the ink holders 47 can be sealed up. This can surely prevent ink contained in the nozzles from drying up. Further, since the ink holders 47 are wet with ink, insides of the aforesaid spaces are kept humid. This can more effectively prevent ink contained in the nozzles from drying up.

The ink holders 47, which are elastic, are disposed while being compressed in order to produce substantially no gap between the ink holders 47 and the inner wall of the cavity 45. This can restrain a problem that inside of the printer 1 is polluted with ink, although this problem may be caused when, while the cap unit 41 is in the capping position, a large amount of ink which cannot be held in the ink holders 47 and thus is accumulated in a gap between the ink holders 47 and the inner wall of the cavity 45 flows out through the communication holes 46.

The waste ink reservoir 71 is provided, and ink discharged through the communication holes 46 of the cap 43 flows into the waste ink reservoir 71. This can prevent the inside of the printer 1 from being polluted with the ink discharged through the communication holes 46.

Moreover, the ink absorber 73 is provided in the waste ink reservoir 71, to prevent ink from scattering when ink discharged through the communication holes 46 flows into the waste ink reservoir 71. Therefore, pollution of the inside of the printer 1 can more effectively be prevented.

When the cap unit 41 is in the capping position shown in FIG. 5A, the protrusions 74 of the ink absorber 73 is disposed in the openings 42*b* of the casing 42. Accordingly, the ink discharged through the communication holes 46 of the cap 43 is surely absorbed via the protrusions 74 into the ink absorber 73 without scattering to outside of the cap unit 41, thereby preventing the pollution of the inside of the printer 1.

When the cap unit 41 is moved by means of the movement mechanism 51 as in this embodiment, the construction becomes simpler as compared with when the head unit 8 is moved toward and away from the cap unit 41.

In the above-described embodiment, when performing a purge operation, the cap unit 41 is placed in the uncapping position where the cap unit 41 is not in contact with the ink ejection faces 4*a*. However, the cap unit 41 may be placed in the capping position where the cap unit 41 is in contact with the ink ejection faces 4*a*. In this case, ink discharged by the purge operation can surely be prevented from scattering to outside of the cap unit 41. In the above-described embodiment, nevertheless, even when the cap unit 41 is in the uncapping position, almost all of ink ejected from the nozzles passes through the openings 44 of the cap 43 and lands on the ink holders 47, because the openings 44 are formed at positions confronting the respective ink ejection faces 4*a*. Consequently, ink does not scatter to the outside of the cap unit 41.

A portion of the ink absorber 73 in contact with the ink holders 47, when the cap unit 41 is in the uncapping position shown in FIG. 4, is not limited to the protrusions 74. As long as any portion of the ink absorber 73 and any portion of the ink holders 47 are in contact with each other, ink held in the ink holders 47 are forcibly sucked out by the ink absorber 73.

It is not always necessary that, when the cap unit 41 is in the uncapping position shown in FIG. 5B, the ink holders 47 and the ink absorber 73 can be spaced apart from each other.

In the above-described embodiment, the ink holders 47 provided in the cap 43, the cap unit 41, and the movement mechanism 51 function as a liquid discharge restriction mechanism. However, this is not limitative. For example, it may be possible to provide, on the cap unit 41, a valve which closes the communication holes 46 when the cap unit 41 is in the capping position and opens the communication holes 46 when the cap unit 41 is in the uncapping position. The valve and a mechanism that opens and closes the valve may be used as the liquid discharge restriction mechanism of the present invention. In this case, since the valve closes the communication holes 46 when the cap unit 41 is in the capping position, ink contained within the nozzles can be prevented from drying up. When the cap unit 41 is in the uncapping position, the communication holes 46 are opened and therefore, in a case ink is ejected into the cap 43 in a purge operation, ink existing in the cap 43 is discharged through the communication holes 46 into the waste ink reservoir 71. Thus, substantially the same effects as in the above-described embodiment can be obtained. In this case, the ink holders 47 of the cap 43 or the ink absorber 73 of the waste ink reservoir 71 can be omitted.

The ink holders 47 may not necessarily be elastic ones. Also, the ink holders 47 disposed in the cavities 45 of the cap 43 may not necessarily be compressed. The stoppers 50 may not always be provided on the cap 43. The lips 48 may be omitted. The ink absorber 73 may not necessarily have the protrusions 74. The waste ink reservoir 71 and/or the springs 49 may be omitted.

A movement mechanism that moves up and down the head unit 8 may be provided instead of or in addition to the movement mechanism 51 that moves up and down the cap unit 41.

The present invention can be applied not only to serial-type printers in which a head reciprocates during a printing operation, but also to line-type printers in which a head is fixed. In addition, the present invention can also be applied to recording apparatuses such as facsimile machines, copying machines, or the like as well as printers. Moreover, the present invention can also be applied to apparatuses ejecting liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejecting apparatus comprising:

a liquid ejecting head having a liquid ejection face on which a plurality of nozzles are formed;

a cap that covers the liquid ejection face, the cap having an opening through which liquid ejected from the nozzles is received and a discharge port through which liquid is discharged to outside;

a movement mechanism that moves at least one of the liquid ejecting head and the cap so as to allow the cap to take a capping position where the cap covers the liquid ejection face or an uncapping position where the cap is spaced away from the liquid ejection face and capable of receiving liquid ejected from the nozzles;

a pressurized purge unit that makes liquid forcibly ejected from the nozzles into the cap;

a liquid discharge restriction mechanism that restricts liquid from being discharged through the discharge port when the cap is in the capping position, and permits liquid to be discharged through the discharge port when the cap is in the uncapping position, the liquid discharge restriction mechanism comprising a liquid holder that is configured to absorb and to hold liquid and is provided in the cap so as to close the discharge port;

a waste liquid reservoir that receives and holds liquid discharged through the discharge port of the cap; and a liquid absorber that is provided in the waste liquid reservoir to absorb liquid, wherein only when the cap is in the uncapping position, the liquid holder and the liquid absorber are in contact with each other.

2. The liquid ejecting apparatus according to claim 1, wherein the liquid holder has elasticity, and is disposed compressedly in a space within the cap.

3. The liquid ejecting apparatus according to claim 2, wherein the cap further has a stopper that prevents the liquid holder from protruding outward from the opening.

4. The liquid ejecting apparatus according to claim 1, wherein the opening is defined by an annular elastic member that, when the cap is in the capping position, is in contact with the liquid ejection face.

5. The liquid ejecting apparatus according to claim 1, wherein:

the liquid absorber has a protrusion that protrudes toward the discharge port; and only when the cap is in the uncapping position, the protrusion of the liquid absorber is in contact with a portion of the liquid holder exposed through the discharge port.

6. The liquid ejecting apparatus according to claim 1, wherein, when the cap is in the uncapping position, the liquid holder and the liquid absorber are allowed to be spaced apart from each other.

7. The liquid ejecting apparatus according to claim 6, wherein:

the uncapping position includes a first uncapping position close to the capping position and a second uncapping position more distant from the capping position than the first uncapping position is;

the liquid holder and the liquid absorber are spaced apart from each other when the cap is in the first uncapping position; and the liquid holder and the liquid absorber are in contact with each other when the cap is in the second uncapping position.

8. The liquid ejecting apparatus according to claim 1, wherein:

the apparatus further comprises a casing within which the cap is disposed, the casing having a first opening which corresponds to the opening of the cap and a second opening which corresponds to the discharge port of the cap;

the liquid absorber has a protrusion that protrudes toward the discharge port; and when the cap is in the capping position, the protrusion of the liquid absorber is disposed in the second opening of the casing.

9. The liquid ejecting apparatus according to claim 1, wherein the cap is moved by the movement mechanism.

10. The liquid ejecting apparatus according to claim 1, further comprising a biasing member that biases the cap toward the liquid ejection face.

* * * * *